US005653581A

United States Patent [19]

Dixon et al.

[11] Patent Number: 5,653,581

[45] Date of Patent: Aug. 5, 1997

[54] CASE-TIED JOINT FOR COMPRESSOR STATORS

[75] Inventors: William E. Dixon, Jensen Beach; Ranjan Das, Hobe Sound, both of Fla.; John A. Visoskis, Vernon, Conn.; James J. Delaporte, Stateboro, Ga.

[73] Assignee: United Technologies Corporation, Hartford, Conn.

[21] Appl. No.: 346,058

[22] Filed: Nov. 29, 1994

[51] Int. Cl.[6] ..... F01D 9/04

[52] U.S. Cl. ..... 415/209.2; 415/134

[58] Field of Search ..... 415/134, 138, 415/139, 189, 190, 209.1, 209.2

[56] References Cited

U.S. PATENT DOCUMENTS

| | | | |
|---|---|---|---|
| 2,917,276 | 12/1959 | Klompas et al. | 415/209.2 |
| 4,920,742 | 5/1990 | Nash et al. | 415/134 |
| 5,158,430 | 10/1992 | Dixon et al. | 415/134 |
| 5,180,281 | 1/1993 | Burge et al. | 415/209.2 |
| 5,273,397 | 12/1993 | Czachor et al. | 415/134 |
| 5,288,206 | 2/1994 | Bromann et al. | 415/209.2 |

*Primary Examiner*—Edward K. Look
*Assistant Examiner*—Mark Sgantzos
*Attorney, Agent, or Firm*—Norman Friedland

[57] ABSTRACT

The attachment for securing the stator vanes to the outer compressor case includes hooks strategically located with one set in the center of a segment and one set each at either end of each segment. The segments are assembled end to end to form a ring of an array of rows of airfoils for directing air to the compressor blades of a gas turbine engine. Each assembled segment may include three rows of vanes. The axial gap between the structure of the upstream stage of the compressor, the axial and circumferential gap of radially extending pins attached to the "floating" lug-nuts assembled in each pair of hooks and the tight fit of the pins in the center pair of hooks allow for axial and circumferential thermal expansion and the bolted lug-nuts and outer case provide radial restraint, all of which combine to reduce stresses on the airfoil during engine transient conditions.

7 Claims, 3 Drawing Sheets

CASE-TIED JOINT FOR COMPRESSOR STATORS

This invention was made under a U.S. Government contract and the Government has rights herein.

TECHNICAL FIELD

This invention relates to compressor stators for gas turbine engines and particularly to the mechanism for tying segmented compressor stator vanes to the engine case so as to allow thermal growth in the axial and circumferential directions.

BACKGROUND ART

As is well known in the gas turbine engine technology, there is a continual effort to maintain the concentricity of the stationary and rotating parts of the engine and to assure that the high temperature and the hostile environment to which an engine is subjected, does not adversely affect this concentricity. For example, U.S. Pat. No. 5,118,253 granted to James T. Balkcum, III on Jun. 2, 1992 entitled "COMPRESSOR CASE CONSTRUCTION WITH BACKBONE", U.S. Pat. No. 5,180,281 granted to Joseph C. Burge, et al on Jan. 19, 1993 entitled "CASE TYING MEANS FOR GAS TURBINE ENGINE", and U.S. Pat. No. 5,127,797 granted to Kenneth E. Carman on Jul. 7, 1992 entitled "COMPRESSOR CASE ATTACHMENT MEANS" which are commonly assigned to the same assignee as the present patent application, disclose means for attaching the stator and its vanes of the compressor to the engine case. The U.S. Pat. Nos. 5,118,253 and 5,127,797, supra, in particular, include means for permitting circumferential thermal growth and axial and circumferential thermal growth, while restraining radial movement.

As noted in the aforementioned patents, the engine case is relatively thin compared to the rotor and stator components in the compressor section. Hence, the case responds more rapidly to temperature changes than do these other components. Obviously, it is important to hold the clearances of the rotating components and the stationary components surrounding the rotor (outer air seal), in order to assure optimum engine operating performance. Because these clearances are so minute, it inherently is a difficult problem to maintain concentricity of the stator to assure that the tips of the turbine blades in an axial flow turbine do not rub against the outer air seal during the transient conditions where extreme changes in the temperature and mechanical loads are encountered.

The U.S. Pat. No. 5,118,253, supra, attempts to resolve this problem by providing a tongue and groove attachment to the backbone and utilizing a single bolt located intermediate the ends of the stator that extends from the stator to the outer case. Obviously, this mechanical arrangement provides a rigid connection with the ends being sufficiently flexible to allow for the circumferential thermal growth.

The U.S. Pat. No. 5,127,797, supra, includes a tongue and groove assembly that is bolted to the outer case for supporting the stator to the case. This tying assembly, like the structure disclosed in U.S. Pat. No. 5,118,253, supra, forms a rigid connection to the case and stator.

The U.S. Pat. No. 5,180,281, supra, includes a segmented rail with bosses that are adapted to receive bolts for attaching the stator to the case. The portion of the segmented rail between the bosses is made relatively thin so as to be flexible that serves to accommodate the changes in the thermals. Again, this tying arrangement is a rigid connection between the case and stator.

While these rigid types of structures for tying the stator vanes to the outer case are efficacious for certain applications, they are not completely satisfactory for other applications.

Also worthy of note are U.S. Pat. No. 4,920,742 granted to Mash et al on May 1, 1990 and entitled "HEAT SHIELD FOR GAS TURBINE ENGINE FRAME", and U.S. Pat. No. 4,987,736 granted to Ciokajlo et al on Jan. 29, 1991 and entitled "LIGHTWEIGHT GAS TURBINE ENGINE FRAME WITH FREE-FLOATING HEAT SHIELD", respectively. The U.S. Pat. No. 4,920,742, supra, is a liner for protecting the frame of the engine from extreme temperatures and discloses a support assembly for allowing the frame to float freely to avoid the thermal stresses that would otherwise cause warping and malfunctioning of this component. It is noted that the expansion and contraction is in the axial, circumferential and radial directions.

The U.S. Pat. No. 4,987,736, supra, likewise is directed to the heat shield for the turbine discharge gases and relies on nut and bolt assemblies for free floating the heat shield. Likewise, the direction of contraction and expansion is similar to the direction disclosed in the U.S. Pat. No. 4,920,742.

In contrast, this invention particularly addresses problems in the compressor case and relies on a judicious selection of the lug nuts, pins, and bolt assemblies and the discrete tolerances of certain components for allowing the expansion and contraction for thermals in the axial and circumferential directions while restraining movement of the components in the radial direction. In particular, the lug nuts relative to the hook assembly for the stator vanes are free to move and hence, are "floating". This invention contemplates joining three rows of stator vanes to form an integral arcuate segment and joining nine such segments to form an annular stator vane configuration. Three lugs or lug nuts supported in hooks extending radially from the outer diameter of the stator case or shroud are tied to the engine's outer case by a machine bolt and operatively connected to the hooks by pins. The three lugs and hook assemblies for each stator segment are circumferentially spaced in each stator segment and the pins at the end lugs are loosely supported in the hooks and the pins in the center lug are tightly supported in the circumferential direction of the hooks and loosely disposed in the axial direction. The center pin is thusly dimensioned so that it can grow axially while being restrained circumferentially and radially. The overall arrangement of these pins and their relationship to the respective slots allow for the constraints noted immediately above while the ends are capable of expanding and contracting in the axial and circumferential directions. Discrete tolerances between adjacent integral stators allow for axial growth and avoid binding as a result of the thermals.

SUMMARY OF THE INVENTION

An object of this invention is to provide improved attachment means for a compressor case and segmented stator and its vanes for allowing for axial and circumferential thermal growth.

A feature of this invention is to provide free floating stator hooks for supporting three segments of segmented stators that includes three rows of vanes to the outer case.

Another feature of this invention is the provision of a central lug supported to the hooks of the segmented stators with an array of pins located at the ends of and intermediate the ends of each of the segments and the end pins spaced from the walls of each of the slots in the hook and the center pin closely fitting the side slot walls.

Another feature of this invention is the combination of the attachment as described with the rows of segmented stators vanes bolted together in one configuration and welded together in another configuration.

The foregoing and other features of the present invention will become more apparent from the following description and accompanying drawings.

BEST MODE FOR CARRYING OUT THE INVENTION

Figure 1:
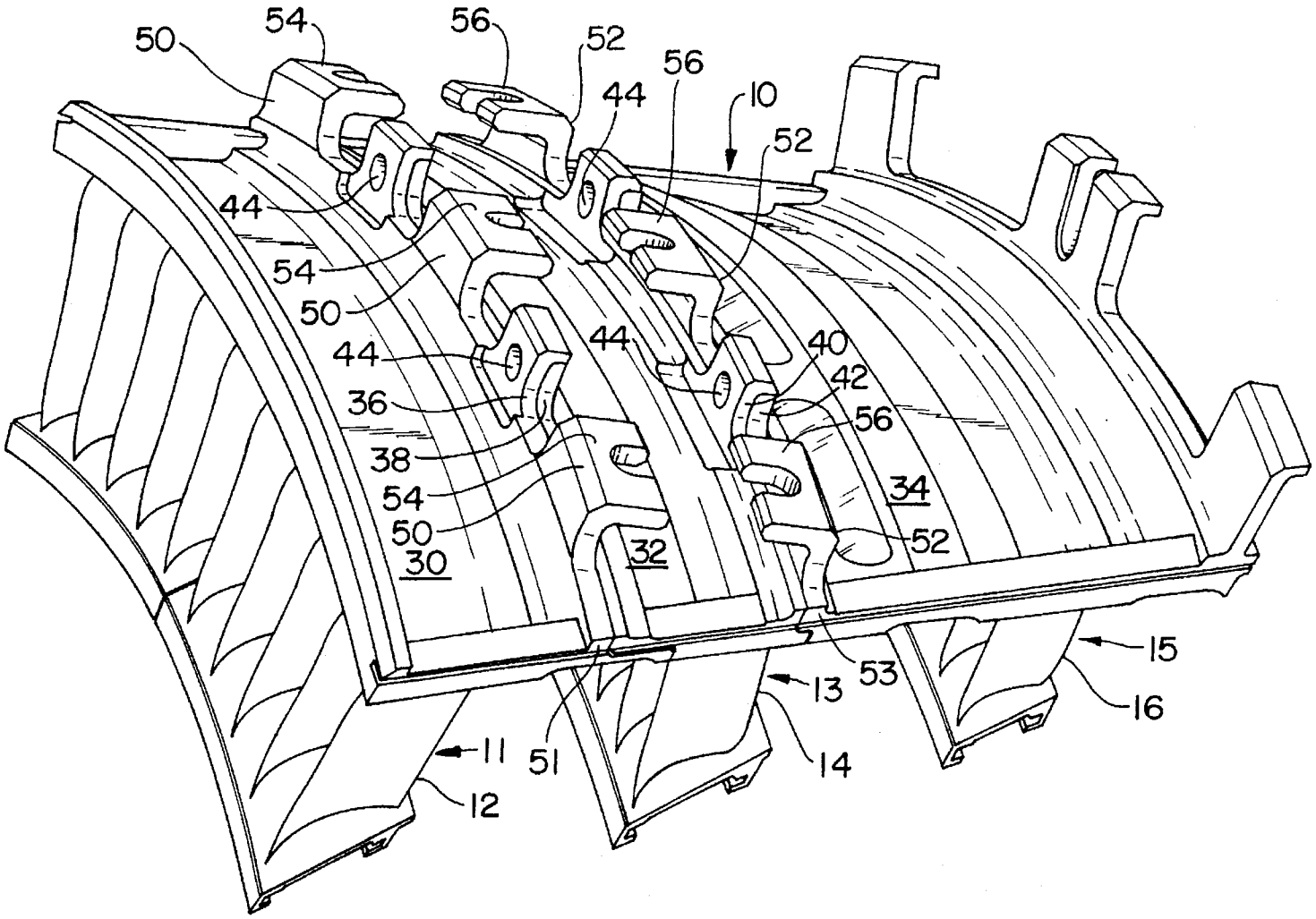
FIG. 1 is a perspective view of a segment of an array of three rows of stator vanes adapted to be bolted together without the attachment structure of this invention.
Figure 2:
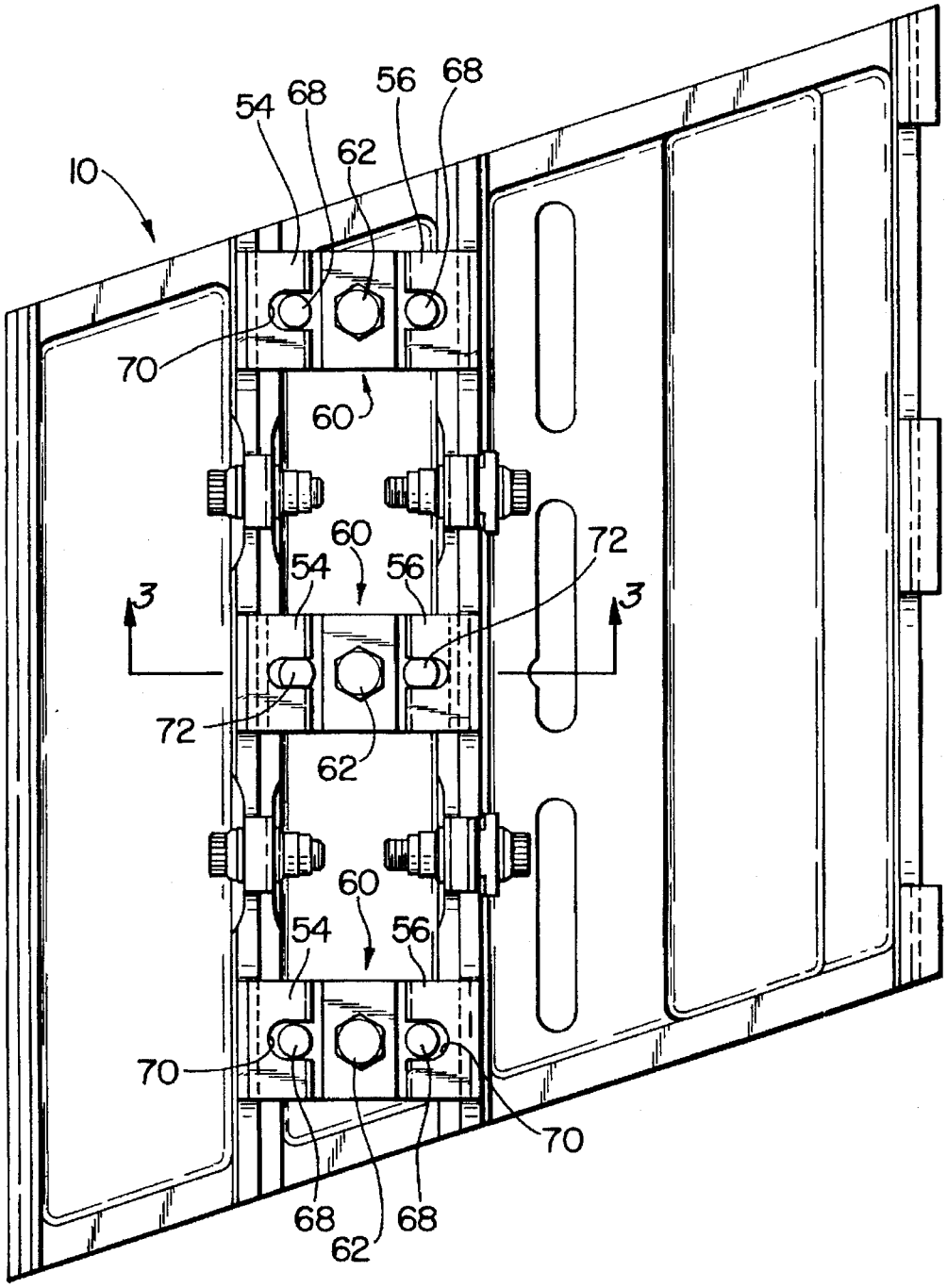
FIG. 2 is a top plan view of the embodiment of FIG. 1 including the attachment structure of this invention.
Figure 3:
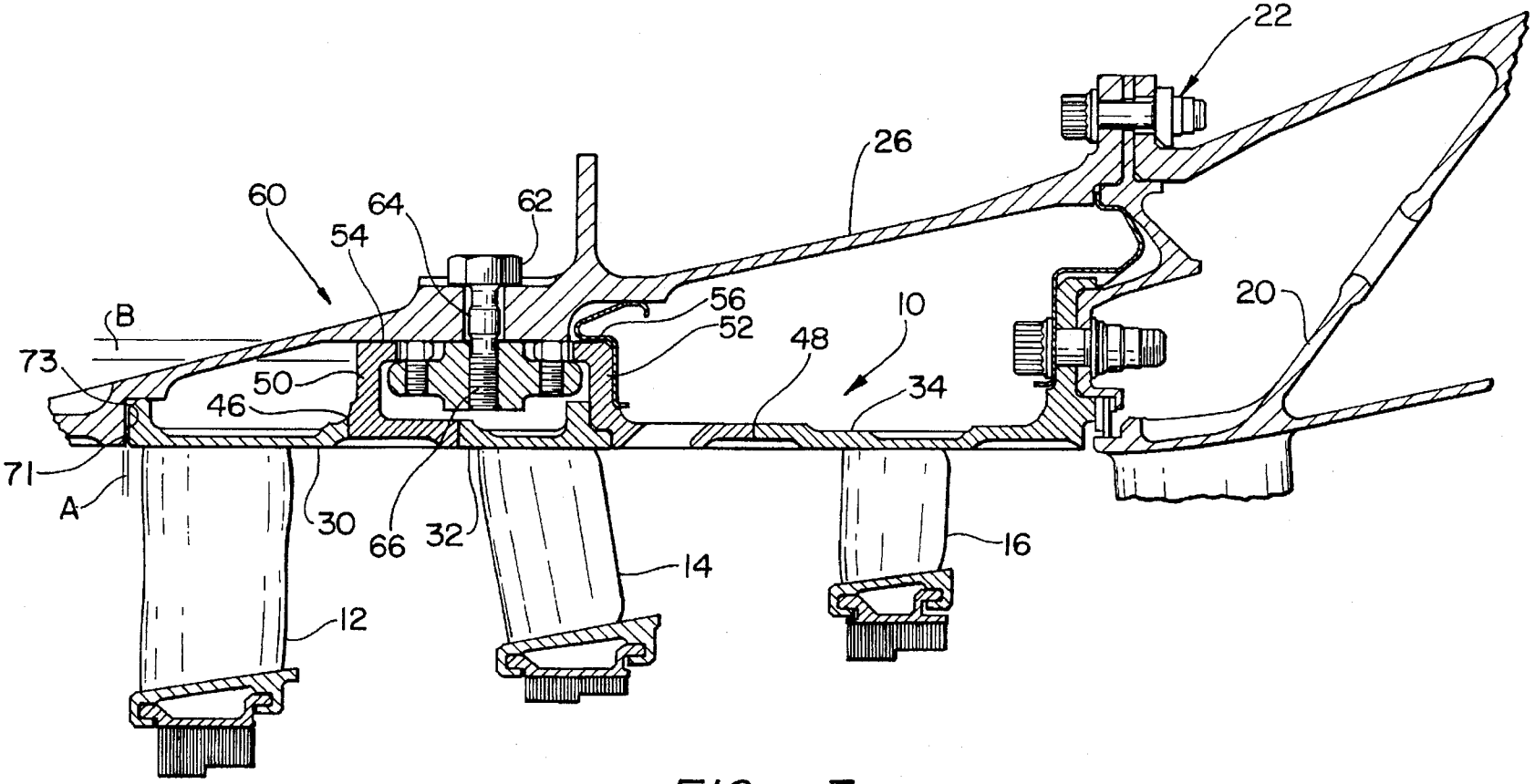
FIG. 3 is a sectional view taken in an axial plane showing the details of one of the lugs and pin arrangements and differs from the structure in FIG. 2 in that the rows of stators and its vanes are welded together rather than being bolted.

The invention is best seen by referring to FIGS. 1–3 showing one segment generally indicated by reference 10 of an array of three segmented rows of stators generally indicated by reference numerals 11, 13 and 15 including segmented stator vanes 12, 14 and 16 suitably attached to the outer diameter walls or shrouds 30, 32 and 34, respectively, for use in the compressor section of a axial flow gas turbine engine. Shrouds 30, 32 and 34 are segmented and each of the segments are arcuate shaped and several segments, say nine (9), are assembled end to end to form three annular stators and their vanes, which are located with respect to the rotating blades (not shown) of the compressor rotor such that the air stream in the gas path of the engine is precisely directed to impinge on the blades of the compressor rotor. These assembled annular stators are mounted in the compressor section of the engine and form three stages of compression of a multi-stage compressor. As shown in FIG. 3, the next stage 20 (partially shown) is bolted to the outer case by the nut and bolt assembly 22 that attach this stator to the compressor outer case 26.

As was mentioned above, each row in the array of rows of stator vanes is joined to the next adjacent row of stator vanes by either a flange and bolt construction or a weld construction. While the essence of the invention is the same irrespective of the type of construction utilized for attaching purposes, FIGS. 1 and 2 exemplify the bolt and flange construction while FIG. 3 exemplifies the weld construction and it is to be understood that the attachment scheme for attaching the joined array of rows of stator vanes to the compressor case are identical. As noted in FIG. 1 the outer diameter walls 30, 32 and 34 carry a plurality of circumferentially spaced mating flanges 36 and 38 and 40 and 42 that extend radially outward and each include complementary apertures 44 for receiving a plurality of nut and bolt assemblies (not shown) for securing each of the array of rows together to form an integral segment consisting of three rows of stator vanes, as shown. In FIG. 3. the adjacent vanes are joined to each other by the weldments 46 and 48 as shown between walls or shrouds 30 and 32 and 32 and 34, respectively.

According to this invention, a first and second set of circumferentially spaced hook members 50 and 52 radially projecting outward from the annular portions 51 and 53 are disposed adjacent to the fore and aft ends thereof and are circumferentially spaced about the edges of the outer wall 30 of the stator 13. As will be explained in further detail hereinbelow, the circumferential spacing and location of the hook members 50 and 52 are judicious and are selected to provide the desired axial and circumferential thermal expansion. As is apparent from the Figs. each pair of hooks consisting of hook members 50 and 52 are located at the outer ends of each of the segments of the row of stator vanes 14.

Each of the hook members 50 and 52 extend radially outward and each include the axially extending portions 54 and 56 facing each other, as shown in all the Figs., and define a cavity for receiving the lug-nuts generally illustrated by reference numeral 60. Each lug-nut extends between the vertical wall of hook members 50 and 52 and underlie a portion of the axially extending portion 54 and 56. As is apparent from the foregoing these lug-nuts are virtually "floating" in this these cavities. All of the hook members 50 and 52 in each of the segments defining the row of stator vanes 14 are secured to the outer case 26 by a plurality of machine bolts 62 extending through the drilled hole 64 formed in outer case 26 which engages the plurality of threaded portions 66 formed in the lug-nut 60.

Each of the lug-nuts carry a radially extending pin 68 that fit into axially extending slots 70 formed in each of the axially extending portion 54 and 56 of the hook members 50 and 52. Slots 70 in the axially extending portion 54 and 56 are diametrically opposed. The pins 72 are substantially identical to the pins 68 but include flats or facets formed on the sides that fit adjacent the side surfaces of the slots 70 formed in the center hook members 54 and 56. The dimensions of pins 68 and 72 are discretely selected in order to accommodate the axial and circumferential thermal growth of the stators and their vanes. As is apparent from FIG. 2 the pins in the hooks formed on the respective ends of the segment are loosely fitted into slots 70 in both the axial and circumferential direction. However the pins 72 that fit into the center hooks are loosely fitted in the axial direction, but are snugly fitted in the circumferential direction. The purpose of these discrete fits is to allow for the axial and circumferential growth of the entire three row stator vane assembly.

In addition, the axial dimension defined by gap A defined by the dimension formed between the shoulder 71 of case 26 and the fore edge 73 of the outer diameter wall 30 and the gap B defined as the dimension between the top surface of lug-nut 60 that underlies the axial extension portions 54 and 56 and the underneath surface of the outer case 26 were discretely selected to accomodate the axial thermal growth of the stator vanes (FIG. 3). By maintaining a close circumferential fit of the pins 72 for holding the segment center fixed and a loose fit by the pins 70 at the segment edges, this arrangement serves to reduce stresses of the airfoil of the stator vanes during engine transient operations.

Although this invention has been shown and described with respect to detailed embodiments thereof, it will be appreciated and understood by those skilled in the art that various changes in form and detail thereof may be made without departing from the spirit and scope of the claimed invention.

It is claimed:

1. For a gas turbine engine that includes a compressor section having a plurality of rows of rotors and a plurality of rows of segmented stators, each of said rows of segmented stators having a plurality of circumferentially spaced vanes defining multi-stages of compression, a compressor outer case for supporting said rows of stators, at least one row of said rows of segmented stators having a fore edge and an aft edge, outer wall means disposed adjacent to said fore edge and said aft edge and being segmented to complement the segments of said segmented stators, said segmented outer wall means having a plurality of sets of hooks extending radially outward from said outer wall means and being spaced in a circumferential direction, two sets of said plurality of hooks with one each of said two sets of hooks being disposed at the opposite ends of said one row of segmented stators, a third set of hooks of said plurality sets of hooks being disposed intermediate said two sets of hooks, each set of hooks of said plurality of hooks including two axially spaced hooks, a plurality of floating lug-nuts each including a first pair and a second pair of radially extending pins fitting into slots formed in each of said two axially spaced hooks of each of said two sets of hooks, a third pair of radially extending pins fitting into slots formed in said third set of hooks, said first pair of pins and said second pair of pins being loosely fitted in the axial and circumferential direction in said slots and said third pair of pins being loosely fitted in the axial direction and tightly fitted in the circumferential direction in said slots and bolt means extending through an aperture formed in said outer case threadably engaging at least one of said lug-nuts for securing said segmented stators to said compressor outer case.

2. For a gas turbine engine as claimed in claim 1 wherein each of said axially spaced hooks of said hook sets includes a vertical portion and a horizontal portion defining a cavity, each of said plurality of lug-nuts includes an axial extending portion disposed in said cavity and extending to underlie said horizontal portion, said first pair of pins, said second pair of pins and said third pair of pins operatively connected to said hooks through said slots formed in said horizontal portion.

3. For a gas turbine engine as claimed in claim 2 wherein said horizontal portion of each of the axially spaced hooks in a set of hooks face each other, and each of said pins extend in said slots formed in each axially spaced hooks of said set of hooks that face each other.

4. For a gas turbine engine as claimed in claim 3 wherein said outer case includes a plurality of separate cases for supporting stages of said multi-stage compression, one case of said separate cases having a shoulder supporting said arcuate segmented stator vanes, said outer wall means having an edge portion complementing and adjacent to said shoulder defining therewith a gap for allowing axial thermal expansion of said one case of said separate cases.

5. For a gas turbine engine as claimed in claim 4 wherein said wall means includes a first annular wall supporting a first plurality of vanes in one of said rows, a second annular wall supporting a second plurality of vanes in another of said rows, and a third annular wall supporting a third plurality of vanes in a third of said rows, said first annular wall having a first side surface and said second annular wall having a second side surface complementing said first side surface, said third annular wall having a third side surface, said second annular wall having another side surface complementing said third side surface, said means for attaching said wall means including a weldment between said first side surface and said second side surface and an additional weldment between said another side surface and said third side surface.

6. For a gas turbine engine as claimed in claim 4 wherein said wall means includes a first annular wall supporting a first plurality of vanes in one of said rows, a second annular wall supporting a second plurality of vanes in another of said rows, and a third annular wall supporting a third plurality of vanes in a third of said rows, said first annular wall having a first side surface and said second annular wall having a second side surface complementing said first side surface and being disposed in side by side relationship, said third annular wall having a third side surface, said second annular wall having another side surface complementing said third side surface and being disposed in side by side relationship, said means for attaching said wall means includes complementing flange means radially extending from each of said first annular wall means, said second annular wall means and said third annular wall means, and securing means extending through complementing holes formed in said complementing flange means for attaching said first annular wall, said second annular wall and said third annular wall.

7. For a gas turbine engine as claimed in claim 1 wherein said bolt means includes a plurality of bolts each of which having a shank portion threaded at one end and a head portion, and said shank portion extending through a plurality of apertures formed in said outer case and threadably engaging said plurality of lug-nuts and said head portion bearing against said outer case.

* * * * *